US009332364B2

(12) United States Patent
Goldstein

(10) Patent No.: US 9,332,364 B2
(45) **Date of Patent: *May 3, 2016**

(54) METHOD AND DEVICE FOR PERSONALIZED HEARING

(71) Applicant: Personics Holdings, LLC, Boca Raton, FL (US)

(72) Inventor: Steven Wayne Goldstein, Delray Beach, FL (US)

(73) Assignee: Personics Holdings, L.L.C., Boca Raton, FL (US)

( * ) Notice: Subject to any disclaimer, the term of this patent is extended or adjusted under 35 U.S.C. 154(b) by 132 days.

This patent is subject to a terminal disclaimer.

(21) Appl. No.: 14/279,315

(22) Filed: May 16, 2014

(65) Prior Publication Data

US 2014/0247952 A1 Sep. 4, 2014

Related U.S. Application Data

(63) Continuation of application No. 11/942,370, filed on Nov. 19, 2007, now Pat. No. 8,774,433.

(60) Provisional application No. 60/866,420, filed on Nov. 18, 2006.

(51) Int. Cl.

| | |
|---|---|
| ***H04R 25/00*** | (2006.01) |
| ***H04R 29/00*** | (2006.01) |
| ***H04R 1/10*** | (2006.01) |
| ***H04R 3/00*** | (2006.01) |

(52) U.S. Cl.

CPC ..... *H04R 29/00* (2013.01); *H04R 1/1016* (2013.01); *H04R 1/1041* (2013.01); *H04R 3/002* (2013.01); *H04R 29/001* (2013.01); *H04R 29/008* (2013.01); *H04R 2420/07* (2013.01); *H04R 2430/03* (2013.01)

(58) Field of Classification Search

CPC ..... G10K 11/178; G10K 11/1784; G10K 11/1788; G10K 2201/129; G10K 2201/1291; H04R 25/00; H04R 25/60; H04R 25/65; H04R 25/356; H04R 25/407; H04R 25/453; H04R 25/456; H04R 25/502; H04R 25/505; H04R 25/552; H04R 25/554; H04R 2225/03; H04R 2225/025; H04R 2225/43; H04R 2430/03; H04R 2460/13

See application file for complete search history.

(56) References Cited

U.S. PATENT DOCUMENTS

| | | | | |
|---|---|---|---|---|
| 4,430,754 | A | 2/1984 | Ishigaki | |
| 6,415,034 | B1 * | 7/2002 | Hietanen | G10K 11/1788 381/151 |
| 6,661,901 | B1 | 12/2003 | Svean et al. | |
| 6,754,359 | B1 | 6/2004 | Svean et al. | |
| 7,450,730 | B2 * | 11/2008 | Berg | A61B 5/00 381/312 |
| 7,836,771 | B2 | 11/2010 | Killien | |
| 2003/0144603 | A1 | 7/2003 | Zota et al. | |
| 2006/0262938 | A1 * | 11/2006 | Gauger, Jr. | G10L 21/02 381/56 |

OTHER PUBLICATIONS

PCT/US07/85134 International Search Report and Written Opinion Dated Jun. 12, 2008. (10 Pages).

* cited by examiner

*Primary Examiner* — Brian Ensey
(74) *Attorney, Agent, or Firm* — Pablo Meles

(57) ABSTRACT

An electronic audio device for use with at least one earpiece or a pair of earpieces, or a pair of earpieces in a headphone, each earpiece having a microphone and a speaker located therein, including circuitry operatively coupled to the microphone and speaker, and a processor operatively coupled to evaluate a seal quality of the earpiece to a user's ear based on seal quality measurements made while driving or exciting a signal into the speaker located in the earpiece and then to adjust the circuitry coupled to the microphone and speaker according to the evaluated seal quality.

19 Claims, 6 Drawing Sheets

700

METHOD AND DEVICE FOR PERSONALIZED HEARING

CROSS REFERENCE TO RELATED APPLICATIONS

This Application is a Continuation Application of U.S. Non-Provisional application Ser. No. 11/942,370 filed on Nov. 19, 2007 and claims the priority benefit of Provisional Application No. 60/866,420 filed on Nov. 18, 2006, the entire disclosures of which are incorporated herein by reference.

FIELD

The present invention relates to a device that monitors and adjusts acoustic energy directed to an ear, and more particularly, though not exclusively, to an earpiece and method of operating an earpiece that monitors and safely adjusts audio delivered to a user's ear.

BACKGROUND

On a daily basis, people are exposed to potentially harmful noises in their environment, such as the sounds from television, traffic, construction, radio, and industrial appliances. Normally, people hear these sounds at safe levels that do not affect their hearing. However, when people are exposed to harmful noises that are too loud or of prolonged duration, hair cells in the inner ear can be damaged, causing noise-induced hearing loss (NIHL). The hair cells are small sensory cells in the inner ear that convert sound energy into electrical signals that travel to the auditory processing centers of the brain. Once damaged, the hair cells cannot grow back. NIHL can be caused by a one-time exposure to an intense impulse or burst sound, such as an alarm, or by continuous exposure to loud sounds over an extended period of time.

In the mobile electronic age, people are frequently exposed to noise pollution from cell phones (e.g., incoming phone call sounds), portable media players (e.g., message alert sounds), and laptops (e.g., audible reminder prompts). Moreover, headphones and earpieces are directly coupled to the person's ear and can thus inject potentially harmful audio at unexpected times and with unexpected levels. Furthermore, with headphones, a user is immersed in the audio experience and generally less likely to hearing important sounds within their environment. In some cases, the user may even turn up the volume to hear the audio over the background noises. This can put the user in a compromising situation since they may not be aware of warning cues in their environment as well as putting them at high sound exposure risk.

Although some headphones have electronic circuitry and software to limit the level of audio delivered to the ear, they are not generally well received by the public as a result. Moreover, they do not take into account the person's environment or the person's hearing sensitivity. A need therefore exists for enhancing the user's audible experience while preserving their hearing acuity in their own environment.

SUMMARY

Embodiments in accordance with the present provide a method and device for personalized hearing.

In one embodiment, an earpiece, can include an Ambient Sound Microphone (ASM) to capture ambient sound, an Ear Canal Receiver (ECR) to deliver audio to an ear canal, an ear canal microphone (ECM) to measure a sound pressure level within the ear canal, and a processor to produce the audio from at least in part the ambient sound. The processor can actively monitor a sound exposure level inside the ear canal, and adjust the audio to within a safe and subjectively optimized listening sound pressure level range based on the sound exposure level. The earpiece can include an audio interface to receive audio content from a media player and deliver the audio content to the processor. The processor can selectively mix the audio content with the ambient sound to produce the audio in accordance with a personalized hearing level (PHL). The processor can also selectively filter the audio to permit environmental awareness of warning sounds, and compensate for an ear seal leakage of the device with the ear canal.

In another embodiment, a method for personalized hearing measurement can include generating a frequency varying and loudness varying test signal, delivering the test signal to an ear canal, measuring a Sound Pressure Level (SPL) in the ear canal, generating an Ear Canal Transfer Function (ECTF) based on the test signal and sound pressure level, determining an ear sealing level of the earpiece based on the ECTF, receiving user feedback indicating an audibility and preference for at least a portion of the test signal, and generating a personalized hearing level (PHL) based on the user feedback, sound pressure level, and ear sealing. Further, the method can include measuring an otoacoustic emission (OAE) level in response to the test signal, comparing the OAE level to historical OAE levels, and adjusting a level of incoming audio based on the OAE level, or presenting a notification of the OAE level.

In another embodiment, a method for personalized listening can include measuring an ambient sound, selectively filtering noise from the ambient sound to produce filtered sound, delivering the filtered sound to an ear canal, determining a Sound Pressure Level (SPL) Dose based on a sound exposure level within the ear canal, and adjusting the filtered sound to be within a safe and subjectively optimized listening level range based on the SPL Dose and in accordance with a Personalized Hearing Level (PHL). The SPL Dose can include contributions of the filtered sound delivered to the ear and an ambient residual sound within the ear canal. The method can include spectrally enhancing the audio content in view of a spectrum of the ambient sound and in accordance with the PHL.

DETAILED DESCRIPTION

Figure 1:
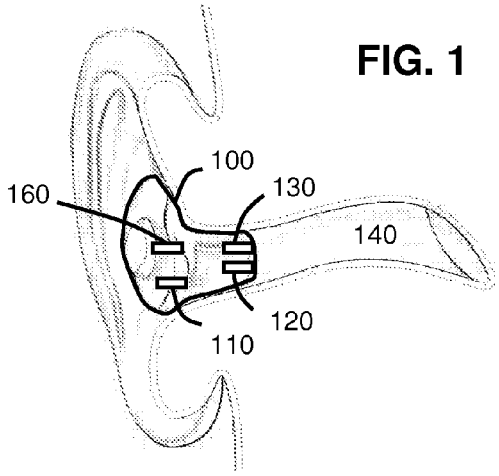
FIG. 1 is a pictorial diagram of an earpiece in accordance with an exemplary embodiment.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and use of transducers. Additionally in at least one exemplary embodiment the sampling rate of the transducers can be varied to pick up pulses of sound, for example less than 50 milliseconds.

In all of the examples illustrated and discussed herein, any specific values, for example the sound pressure level change, should be interpreted to be illustrative only and non-limiting. Thus, other examples of the exemplary embodiments could have different values.

Note that similar reference numerals and letters refer to similar items in the following figures, and thus once an item is defined in one figure, it may not be discussed for following figures.

Note that herein when referring to correcting or preventing an error or damage (e.g., hearing damage), a reduction of the damage or error and/or a correction of the damage or error are intended.

At least one exemplary embodiment of the invention is directed to measuring and adjusting the exposure of sound to the ear over time. Reference is made to FIG. 1 in which an earpiece device, generally indicated as 100, is constructed in accordance with at least one exemplary embodiment of the invention. Earpiece 100 includes an Ambient Sound Microphone (ASM) 110 to capture ambient sound, an Ear Canal Receiver (ECR) 120 to deliver audio to an ear canal 140, and an ear canal microphone (ECM) 130 to assess a sound exposure level within the ear canal. The earpiece 100 can also include an Ear Receiver (ER) 160 to generate audible sounds external to the ear canal 140. The earpiece 100 can partially or fully occlude the ear canal 140 to provide various degrees of acoustic isolation.

The earpiece 100 can actively monitor a sound pressure level both inside and outside an ear canal and enhance spatial and timbral sound quality while maintaining supervision to ensure safe reproduction levels. The earpiece 100 in various embodiments can conduct listening tests, filter sounds in the environment, monitor warning sounds in the environment, present notification based on identified warning sounds, maintain constant audio content to ambient sound levels, and filter sound in accordance with a Personalized Hearing Level (PHL). The earpiece 100 is suitable for use with users having healthy or abnormal auditory functioning.

The earpiece 100 can generate an Ear Canal Transfer Function (ECTF) to model the ear canal 140 using ECR 120 and ECM 130, as well as an Outer Ear Canal Transfer function (OETF) using ER 160 and ASM 110. The earpiece can also determine a sealing profile with the user's ear to compensate for any leakage. In one configuration, the earpiece 100 can provide personalized full-band width general audio reproduction within the user's ear canal via timbral equalization using a multiband level normalization to account for a user's hearing sensitivity. It also includes a Sound Pressure Level Dosimeter to estimate sound exposure and recovery times. This permits the earpiece to safely administer and monitor sound exposure to the ear.

Figure 2:
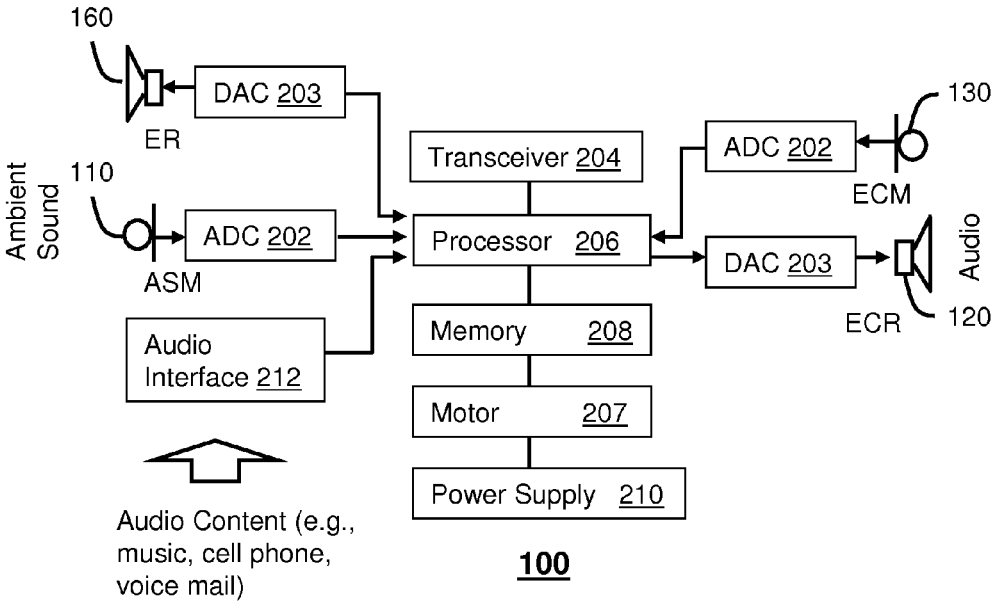
FIG. 2 is a block diagram of the earpiece in accordance with an exemplary embodiment.

Referring to FIG. 2, a block diagram of the earpiece 100 in accordance with an exemplary embodiment is shown. As illustrated, the earpiece 100 can further include a processor 206 operatively coupled to the ASM 110, ECR 120, ECM 130, and ER 160 via one or more Analog to Digital Converters (ADC) 202 and Digital to Analog Converters (DAC) 203. The processor 206 can produce audio from at least in part the ambient sound captured by the ASM 110, and actively monitor the sound exposure level inside the ear canal 140. The processor responsive to monitoring the sound exposure level can adjust the audio in the ear canal 140 to within a safe and subjectively optimized listening level range. The processor 206 can utilize computing technologies such as a microprocessor, Application Specific Integrated Chip (ASIC), and/or digital signal processor (DSP) with associated storage memory 208 such a Flash, ROM, RAM, SRAM, DRAM or other like technologies for controlling operations of the earpiece device 100.

The earpiece 100 can further include a transceiver 204 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 204 can also provide support for dynamic downloading over-the-air to the earpiece 100. It should be noted also that next generation access technologies can also be applied to the present disclosure.

The earpiece 100 can also include an audio interface 212 operatively coupled to the processor 206 to receive audio content, for example from a media player, and deliver the audio content to the processor 206. The processor can suppress noise within the ambient sound and also mix the audio content with filtered ambient sound. The power supply 210 can utilize common power management technologies such as replaceable batteries, supply regulation technologies, and charging system technologies for supplying energy to the components of the earpiece 100 and to facilitate portable applications. The motor 207 can be a single supply motor driver to improve sensory input via haptic vibration. As an example, the processor 206 can direct the motor 207 to vibrate responsive to an action, such as a detection of a warning sound or an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

Figure 3:
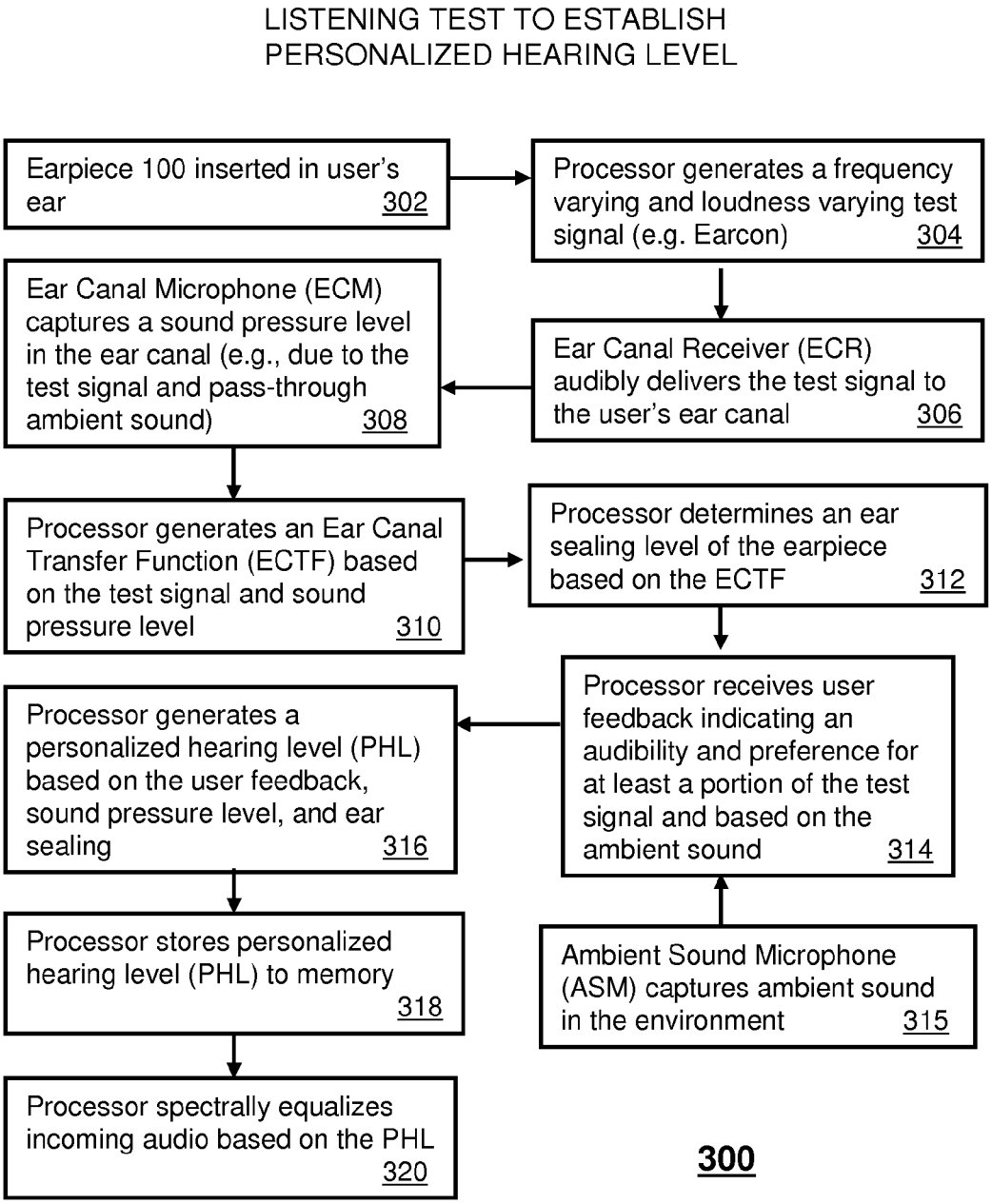
FIG. 3 is a flowchart of a method for conducting a listening test to establish a personalized hearing level (PHL) in accordance with an exemplary embodiment.

FIG. 3 is a flowchart of a method 300 for conducting a listening test in accordance with an exemplary embodiment. The method 300 is also directed to establishing a personalized hearing level (PHL) for an individual earpiece 100 based on results of the listening test, which can identify a minimum threshold of audibility and maximum loudness comfort metric. The method 300 can be practiced with more or less than the number of steps shown and is not limited to the order shown. To describe the method 300, reference will be made to components of FIGS. 1, 2 and 4, although it is understood that the method 300 can be implemented in any other manner using other suitable components. The method 300 can be implemented in a single earpiece, a pair of earpieces, or headphones.

The method 300 for conducting a listening test can start at step 302 at which the earpiece 100 is inserted in user's ear. The listening test can be a self-administered listening test initiated by the user, or an automatic listening test intermittently scheduled and performed by the earpiece 100. For example, upon inserting the earpiece 100, the user can initiate the listening test. Alternatively, the earpiece, as will be described ahead, can determine when the earpiece is inserted and then proceed to commence operation. In one arrangement, the earpiece 100 can monitor ambient noise within the environment and inform the user whether an proper listening test can be conducted in the environment. The earpiece 100, can also intermittently prompt the use to conduct a listening test, if the earpiece 100 determines that it has dislodged or that a seal with the ear canal has been compromised.

At step 304, the processor 206 can generate a frequency varying and loudness varying test signal. The test signal can a swept sinusoid, chirp signal, band-limited noise signal, band-limited music signal, or any other signal varying in frequency and amplitude. As one example, the test signal can be a pleasant sounding audio clip called an EarCon that can include a musical component. The EarCon can be audibly presented to the user once the earpiece 100 has been inserted.

At step 306, the Ear Canal Receiver (ECR) can audibly deliver the test signal to the user's ear canal. The earpiece 100 can generate the test signal with sufficient fidelity to span the range of hearing; generally 20 Hz to 20 KHz. The Ear Canal Microphone (ECM) responsive to the test signal at step 308 can capture a sound pressure level (SPL) in the ear canal due to the test signal and a pass-through ambient sound called ambient residual noise. The pass through ambient sound can be present in the ear canal if the earpiece 100 is not properly inserted, or does not inherently provide sufficient acoustic isolation from ambient noise in the environment. Accordingly, the SPL measured within the ear canal can include both the test signal and a contribution of the ambient residual noise.

Figure 4:
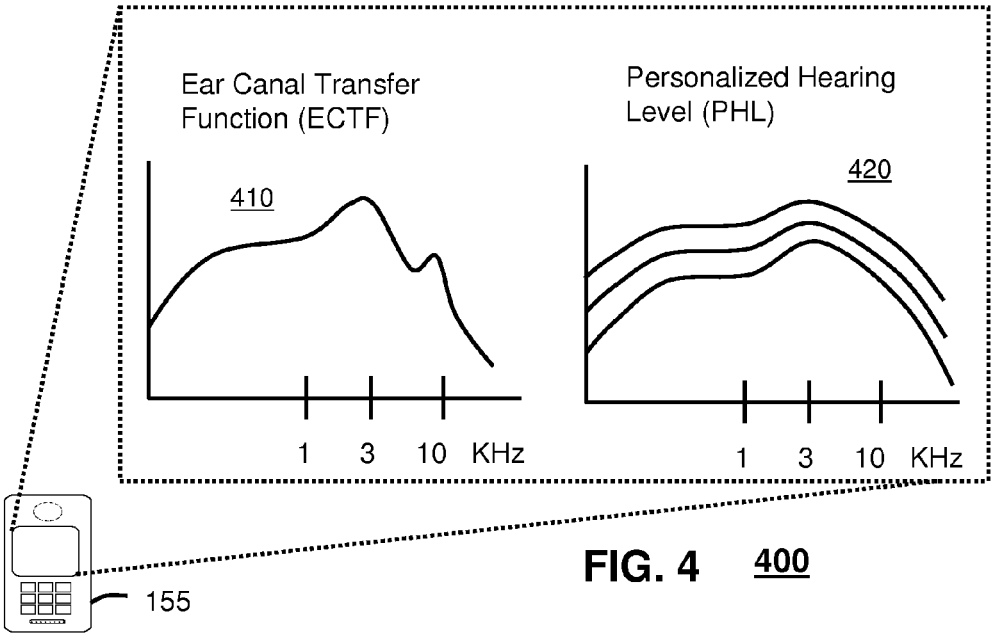
FIG. 4 illustrates an exemplary ear canal transfer function and an exemplary PHL in accordance with an exemplary embodiment.

The processor 206 can then at step 310 generate an Ear Canal Transfer Function (ECTF) based on the test signal and sound pressure level. The ECTF models the input and output characteristics of the ear canal 140 for a current physical earpiece insertion. The ECTF can change depending on how the earpiece 100 is coupled or sealed to the ear (e.g., inserted). (Briefly, FIG. 4 shows an exemplary ECTF 410, which the processor 206 can display, for example, to a mobile device 100 paired with the earpiece 100.) In one arrangement, the processor 206 by way of the ECR 120 and ECM 130 can perform in-situ measurement of a user's ear anatomy to produce an Ear Canal Transfer Function (ECTF) when the device is in use. The processor 206 can chart changes in amplitude and phase for each frequency of the test signal during the listening test. The ECTF analysis also permits the processor to identify between insertion in the left and right ear. The left and the right ear in addition to having different structural features can also have different hearing sensitivities.

At step 312, the processor 206 can determine an ear sealing level of the earpiece based on the ECTF. For instance, the processor 206 can compare the ECTF to historical ECTFs captured from previous listening tests, or from previous intermittent ear sealing tests. An ear sealing test can identify whether the amplitude and phase difference of the ECTF are particular to a specific ear canal. Notably, the amplitude will be generally higher if the earpiece 100 is sealed within the ear canal 140, since the sound is contained within a small volume area (e.g. ~5 cc) of the ear canal. The processor 206 can continuously monitoring the ear canal SPL using the ECM 130 to detect a leaky earpiece seal as well as identify the leakage frequencies. The processor 206 can also monitor a sound leakage from the ECR 120 using the ASM 110 to detect sound components correlated with the audio radiated by the ECR into the ear canal 140.

In another embodiment, the processor 206 can measure the SPL upon delivery of the test signal to determine an otoacoustic emission (OAE) level, compare the OAE level to historical OAE levels, and adjust a level of incoming audio based on the OAE level. OAEs can be elicited in the vast majority of ears with normal hearing sensitivity, and are generally absent in ears with greater than a mild degree of cochlear hearing loss. Studies have shown that OAEs change in response to insults to the cochlear mechanism from noise and from ototoxic medications, prior to changes in the pure-tone audiogram. Accordingly, the processor can generate a notification to report that the user may have temporary hearing impairment if the OAE levels significantly deviate from their historical levels.

The processor 206 can also measure an ambient sound level outside the ear canal for selected frequencies, compare the ambient sound with the SPL for the selected frequencies of the ambient sound, and determine that the earpiece is inserted if predetermined portions of the ECTF are below a threshold (this test can be conducted when the test signal is not audibly present). As previously noted, the SPL within the ear canal includes the test signal and an ambient residual noise incompletely sealed out and leaking into the ear canal. Upon completion of the ear sealing test, the processor 206 can generate an audible message identifying the sealing profile and whether the earpiece is properly inserted, thereby allowing the user to re-insert or adjust the earpiece 100. The processor 206 can continue to monitor changes in the ECTF throughout active operation to ensure the earpiece 100 maintains seal with the ear canal 140.

Upon presenting the test signal to the earpiece 100, the processor 206 at step 314 can receive user feedback indicating an audibility and preference for at least a portion of the test signal. It should also be noted, that the processor can take into account the ambient noise measurements captured by the ASM 110, as shown in step 315. In such regard, the processor 206 can determine the user's PHL as a function of the background noise. For instance, the processor 206 can determine masking profiles for certain test signal frequencies in the presence of ambient noise.

The processor 206 can also present narrative information informing the user about the status of the listening test and ask the user to provide feedback during listening test. For example, a synthetic voice can state a current frequency (e.g. "1 KHz") of the test signal and ask the user if they can hear the tone. The processor 206 can request feedback for multiple frequencies across the hearing range along a ⅓ frequency band octave scale, critical band frequency scale, or any other hearing scale and chart the user's response. The processor 206 can also change the order and timing of the presentation of the test tones to minimize effects of psychoacoustic amplitude and temporal masking. Briefly, the EarCon is a specific test signal psychoacoustically designed to maximize the separation of audio cues and minimize the effects of amplitude and temporal masking to assess a user's hearing profile.

During the listening test, a minimum audible threshold curve, a most comfortable listening level curve, and an uncomfortable listening level curve can be determined from the user's feedback. A family of curves or a parameter set can thus be calculated to model the dynamic range of the persons hearing based on the listening test. Accordingly, at step 316, the processor 206 can generate a personalized hearing level (PHL) based on the user feedback, sound pressure level, and ear sealing. (Briefly, FIG. 4 also shows an exemplary PHL 420, which the processor 206 can display, for example, to a mobile device 100 paired with the earpiece 100.) The PHL 420 is generated in accordance with a frequency and loudness level dependent user profile generated from the listening test and can be stored to memory 208 for later reference as shown in step 318. Upon completion of the listening test, the processor 206 can spectrally enhance audio delivered to the ear canal in accordance with the PHL 420, as shown in step 320. It should also be noted that a default PHL can be assigned to a user if the listening test is not performed.

Figure 5:
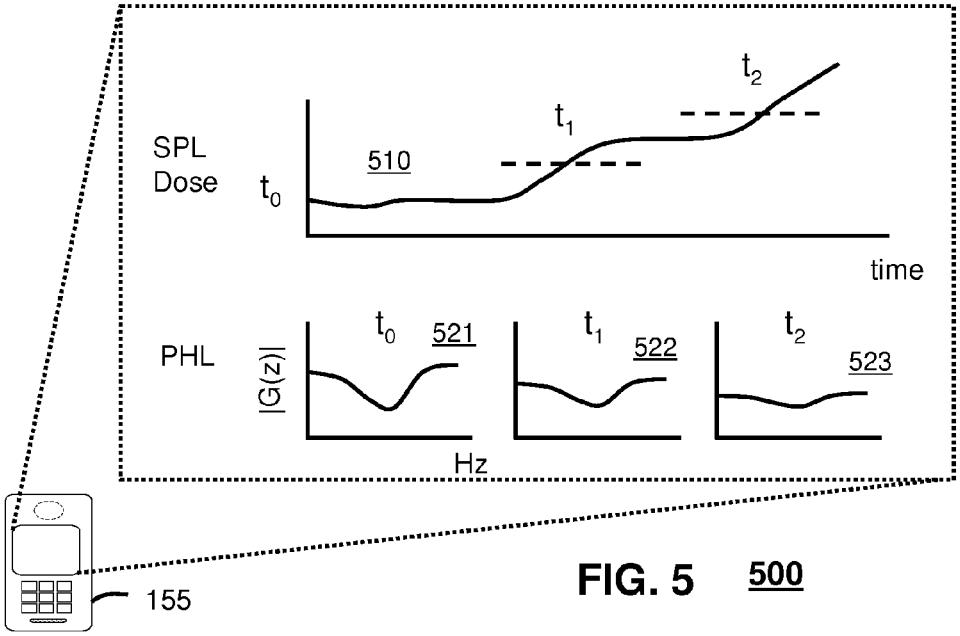
FIG. 5 illustrates a plot of an exemplary Sound Pressure Level (SPL) Dose and corresponding PHL plots in accordance with an exemplary embodiment.
Figure 6:
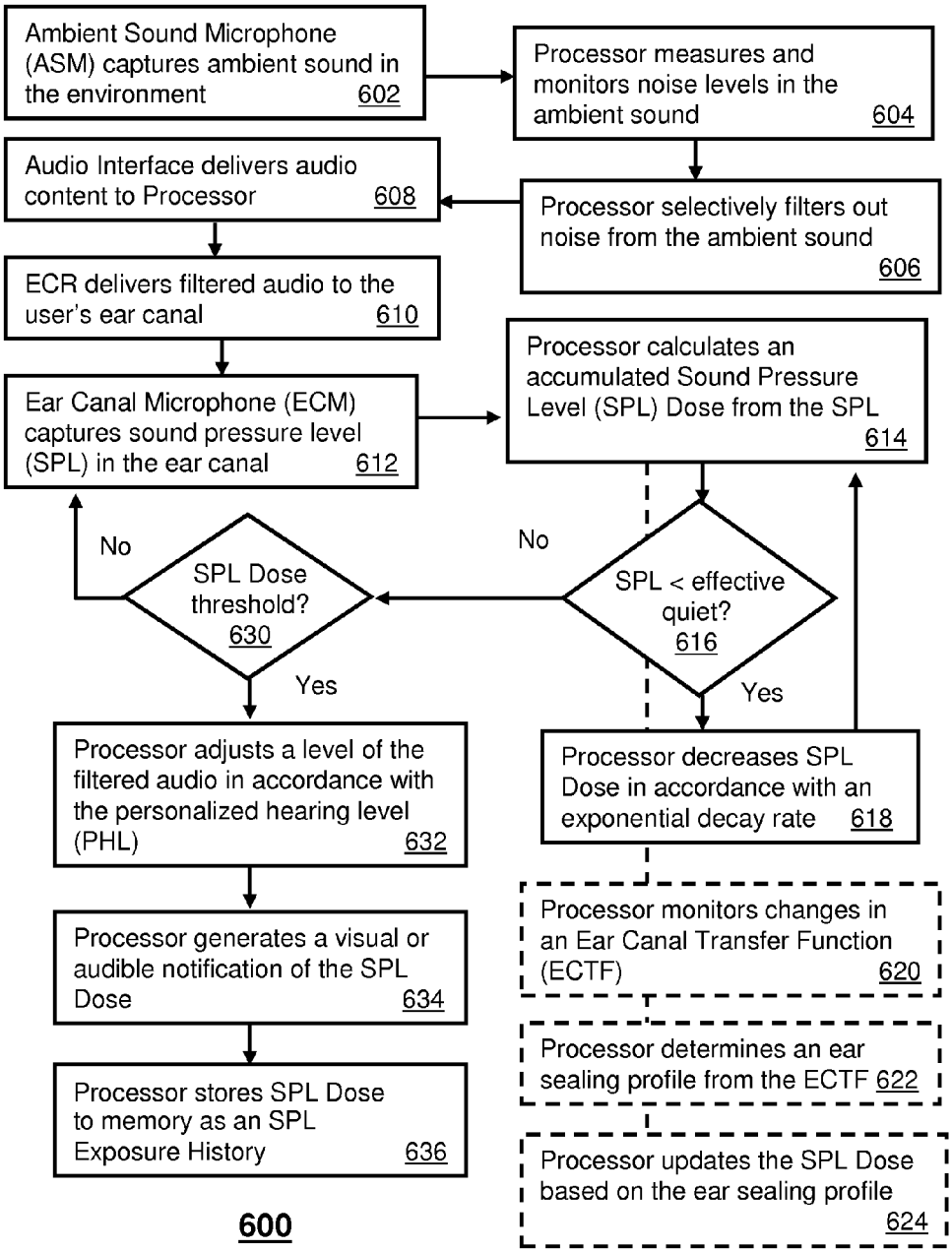
FIG. 6 is a flowchart of a method for audio adjustment using SPL Dose in accordance with an exemplary embodiment.

FIG. 6 is a flowchart of a method 600 for audio adjustment using SPL Dose in accordance with an exemplary embodiment. The method 600 is also directed to filtering environmental noise, measuring an SPL Dose for a filtered audio, and adjusting the filtering in accordance with the SPL Dose and the PHL. The method 600 can be practiced with more or less than the number of steps shown, and is not limited to the order of the steps shown. To describe the method 600, reference will be made to components of FIGS. 1, 2 and 5, although it is understood that the method 600 can be implemented in any other manner using other suitable components. The method 600 can be implemented in a single earpiece, a pair of earpieces, or headphones.

The method 600 can begin in a state wherein the earpiece 100 is inserted in the ear canal and activated. At step 602, the ASM 110 captures ambient sound in the environment. Ambient sound can correspond to environmental noise such as wind noise, traffic, car noise, or other sounds including alarms and warning cues. Ambient sound can also refer to background voice conversations or babble noise. At step 604, the processor 206 can measure and monitor noise levels in the ambient sound. In one arrangement, the processor 206 can include a spectral level detector to measure background noise energy over time. In another arrangement, the processor 206 can perform voice activity detection to distinguish between voice and background noise. At step 606, the processor 206 can selectively filter out the measured noise from the ambient sound. For instance, the processor 206 can implement a spectral subtraction or spectral gain modification technique to minimize the noise energy in the ambient sound. At step 608, the Audio Interface 212 can optionally deliver audio content such as music or voice mail to the processor 206. The processor 206 can mix the audio content with the filtered sound to produce filtered audio. The ECR can then deliver at step 610 the filtered audio to the user's ear canal. The earpiece 100 which inherently provides acoustic isolation and active noise suppression can thus selectively determine which sounds are presented to the ear canal 140.

At step 612, the ECM 130 captures sound exposure level in the ear canal 140 attributed at least in part to pass-through ambient sound (e.g. residual ambient sound) and the filtered audio. Notably, excessive sound exposure levels in the ear canal 140 can cause temporary hearing loss and contribute to permanent hearing damage. Moreover, certain types of sound exposure such as those due to high energy impulses or prolonged wide band noise bursts can severely affect hearing and hearing acuity. Accordingly, at step 614, the processor 206 can calculate a sound pressure level dose (SPL Dose) to quantify the sound exposure over time as it relates to sound exposure and sensorineural hearing loss. The processor 206 can track the sound exposure over time using the SPL Dose to assess an acceptable level of sound exposure.

Briefly, SPL Dose is a measurement, which indicates an individual's cumulative exposure to sound pressure levels over time. It accounts for exposure to direct audio inputs such as MP3 players, phones, radios and other acoustic electronic devices, as well as exposure to environmental or background noise, also referred to as ambient noise. The SPL Dose can be expressed as a percentage of a maximum time-weighted average for sound pressure level exposure. SPL Dose can be cumulative—persisting from day to day. During intense Environmental Noise (above an Effective Quiet level), the SPL Dose will increase. During time periods of negligible environmental noise, the SPL Dose will decrease according to an Ear Recovery Function.

The Ear Recovery Function describes a theoretical recovery from potentially hazardous sound exposure when sound levels are below Effective Quiet. As an example, Effective Quiet can be defined as 74 dB SPL for the octave band centered at 4000 Hz, 78 dB SPL for the octave band centered at 2000 Hz, and 82 dB SPL for the octave bands centered at 500 Hz and 1000 Hz. It is based on audiological research of growth and decay of temporary threshold shift (TTS), which is the temporary decrease in hearing sensitivity that arises from metabolic exhaustion of the sensory cells of the inner ear from exposure to high levels of sound. Sound exposure that results in a TTS is considered sufficient to eventually result in a permanent hearing loss. The recovery from TTS is thought to reflect the improvement in cellular function in the inner ear with time, and proceeds in an exponential and predictable fashion. The Ear recovery function models the auditory system's capacity to recover from excessive sound pressure level exposures.

Accordingly, if at step 616, the filtered audio is less than the Effective Quiet level (determined from the PHL 420 as the minimum threshold of hearing), the processor 206 can decrease the SPL dose in accordance with a decay rate (e.g. exponential). In particular, the processor 206 can calculate a decay of the SPL Dose from the ear recovery function, and reduce the SPL Dose by the decay. During SPL Dose calculation, the filtered audio can be weighted based on a hearing scale (e.g. critical bands) and gain compression function to account for loudness. For example, the filtered sound can be scaled by a compressive non-linearity such as a cubic root to account for loudness growth measured in inner hair cells. This measure provides an enhanced model of an individual's potential risk for Hearing Damage. The SPL Dose continues to decrease so long as the filtered sound is below the Effective Quiet level as shown in step 618.

During SPL Dose monitoring, the processor 206 can occasionally monitor changes in the Ear Canal Transfer Function (ECTF) as shown in step 620. For instance, at step 622, the processor 206 can determine an ear sealing profile from the ECTF as previously noted, and, at step 624, update the SPL Dose based on the ear sealing profile. The SPL Dose can thus account for sound exposure leakage due to improper sealing of the earpiece 100. The ear sealing profile is a frequency and amplitude dependent function that establishes attenuations for the SPD Dose.

If the filtered sound exceeds the Effective Quiet level and the SPL Dose is not exceeded at step 630, the earpiece 100 can continue to monitor sound exposure level within the ear canal 140 at step 612 and update the SPL_Dose. If however the filtered sound exceeds the Effective Quiet level, and the SPL Dose is exceeded at step 630, the processor 206 can adjust (e.g. decrease/increase) a level of the filtered sound in accordance with the PHL at step 632. For instance, the processor 206 can limit a reproduction of sounds that exceed an Uncomfortable Level (UCL) of the PHL, and compress a reproduction of sounds to match a Most Comfortable Level (MCL) of the PHL.

When the ear is regularly overexposed to sound, auditory injuries, such as noise-induced TTS, permanent threshold shift, tinnitus, abnormal pitch perception, and sound hypersensitivity, may occur. Accordingly, the processor 206 can make necessary gain adjustments to the reproduced audio content to ensure safe listening levels, and provide the earpiece 100 with ongoing information related to the accumulated SPL dose.

The SPL Dose can be tiered to various thresholds. For instance, the processor 206 at a first threshold can send a visual or audible warning indicating a first level SPL dose has been exceeded as shown in step 632. The warning can also audibly identify how much time the user has left at the current level before the SPL total dose is reached. For example, briefly referring to FIG. 5, the processor 206 in an exemplary arrangement can apply a first PHL 521 to the filtered audio when the SPL Dose exceeds threshold, $t_0$. The processor 206 at a second threshold $t_2$ can adjust the audio in accordance with the PHL. For instance, as shown in FIG. 5, the processor 206 can effectively attenuate certain frequency regions of the filtered audio in accordance with PHL 522. The processor 206 at a third threshold $t_3$ can attenuate audio content delivered to the earpiece 100. Notably, the SPL Dose and thresholds as shown in FIG. 5 are mere example plots.

At step 636, the processor 206 can log the SPL Dose to memory 208 as an SPL Exposure History. The SPL Exposure History can include real-ear level data, listening duration data, time between listening sessions, absolute time, SPL Dose data, number of acoustic transients and crest-factor, and other information related to sound exposure level. SPL Exposure History includes both Listening Habits History and Environmental Noise Exposure History.

Figure 7:
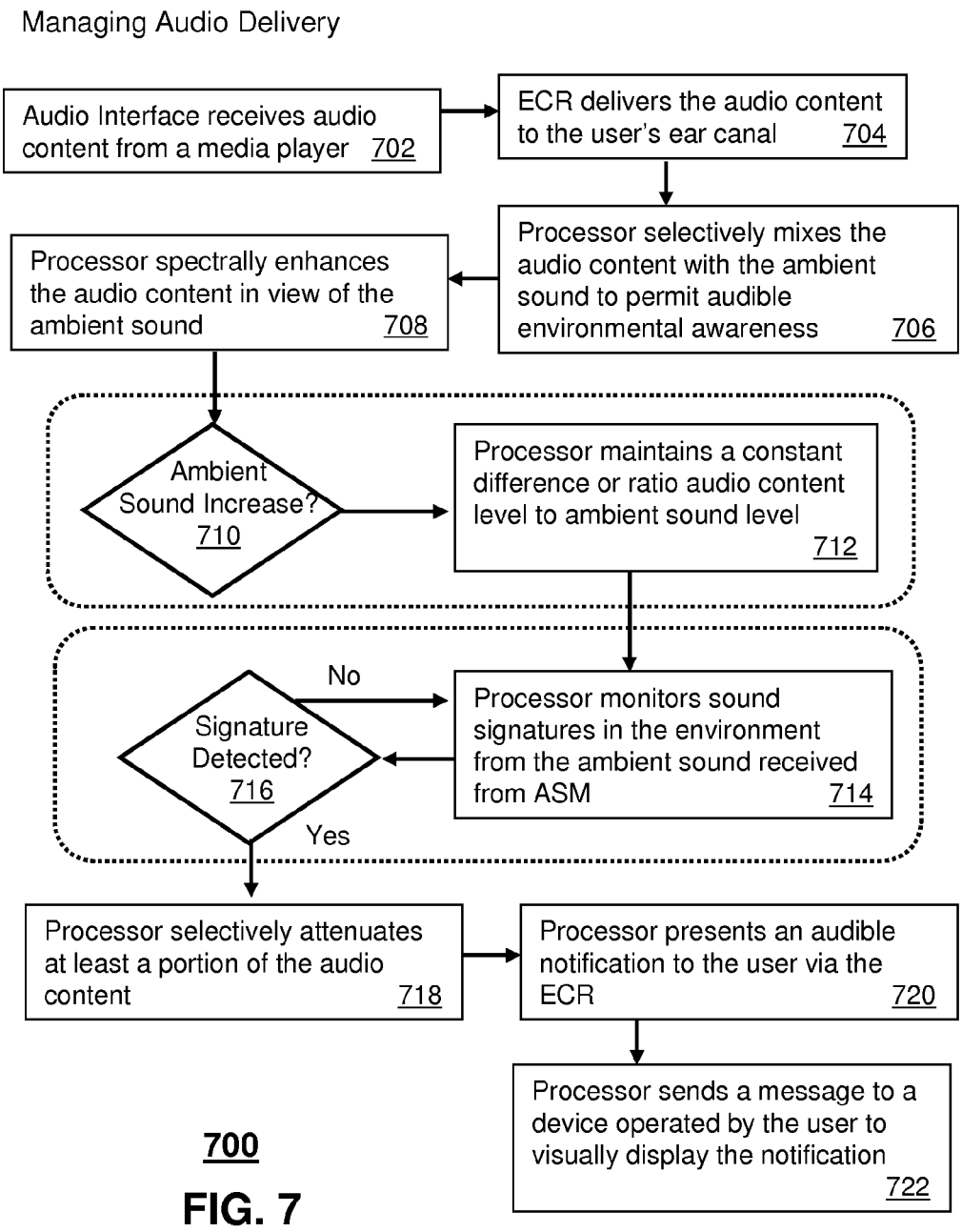
FIG. 7 is a flowchart for managing audio delivery in accordance with an exemplary embodiment.

FIG. 7 is a flowchart of a method 700 for managing audio delivery to an earpiece. The method 700 is also directed to mixing audio content with ambient sound, spectrally enhancing audio, maintaining a constant audio content to ambient sound ratio, and monitoring warning sounds in the ambient sound. The method 700 can be practiced with more or less than the number of steps shown, and is not limited to the order of the steps shown. To describe the method 700, reference will be made to components of FIGS. 1, 2 and 8, although it is understood that the method 700 can be implemented in any other manner using other suitable components.

The method can start in a state wherein a user is wearing the earpiece 100 and it is in an active powered on state. At step 702, the Audio Interface 212 can receive audio content from a media player. The earpiece 100 can be connected via a wired connection to the media player, or via a wireless connection (e.g. Bluetooth) using the transceiver 204 (See FIG. 2). As an example, a user can pair the earpiece 100 to a media player such as a portable music player, a cell phone, a radio, a laptop, or any other mobile communication device. The audio content can be audible data such as music, voice mail, voice messages, radio, or any other audible entertainment, news, or information. The audio format can be in a format that complies with audio reproduction capabilities of the device (e.g., MP3, .WAV, etc.). The Audio Interface 212 can convey the audio content to the processor 206. At step 704, the ECR can deliver the audio content to the user's ear canal 140.

The ASM 110 of the earpiece 100 can capture ambient sound levels within the environment of the user, thereby permitting the processor 206 to monitor ambient sound within the environment while delivering audio content. Accordingly, at step 706, the processor 206 can selectively mix the audio content with the ambient sound to permit audible environmental awareness. This allows the user to perceive external sounds in the environment deemed important. As one example, the processor can allow pass through ambient sound for warning sounds. In another example, the processor can amplify portions of the ambient noise containing salient features. The processor 206 can permit audible awareness so that a listener can recognize at least on distinct sound from the ambient sound. For instance, harmonics of an "alarm" sound can be reproduced or amplified in relation to other ambient sounds or audio content. The processor 206 can filter the audible content and ambient sound in accordance with method 600 using the PHL (see FIG. 5) calculated from the listening tests (see FIG. 3).

Figure 8:
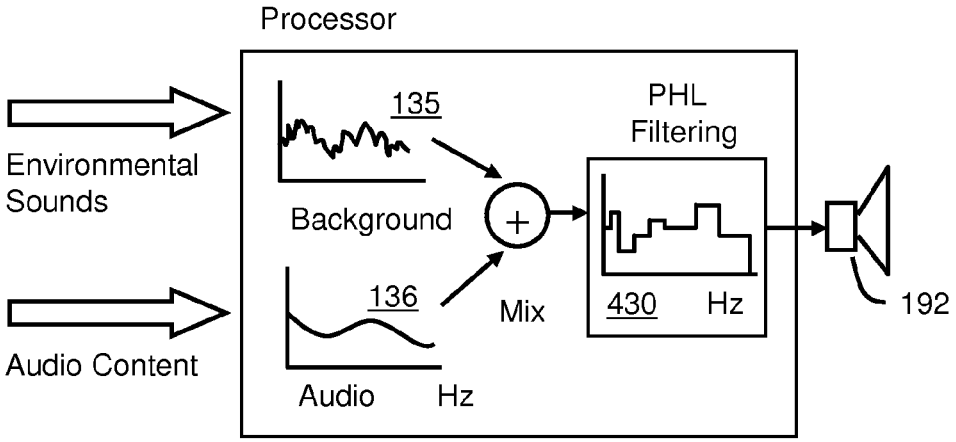
FIG. 8 is a pictorial diagram for mixing environmental sounds with audio content in accordance with an exemplary embodiment.

FIG. 8 is a pictorial diagram for mixing ambient sound with audio content in accordance with an exemplary embodiment. As illustrated, individual frequency spectrums for frames of the ambient sound 135, audio content 136 and PHL 430 are shown. The processor 206 can selectively mix certain frequencies of the audio content 136 with the ambient noise 135 in conjunction with PHL filtering 430 to permit audibility of the ambient sounds. This allows a user to simultaneously listen to audio content while remaining audibly aware of their environment.

Figure 9:
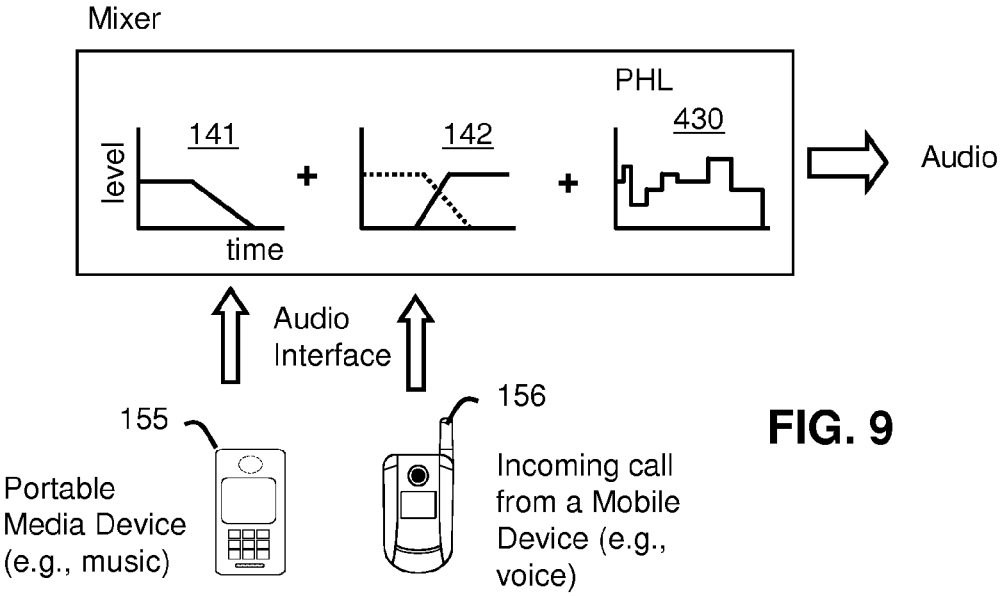
FIG. 9 is a pictorial diagram for mixing audio content from multiple sources in accordance with an exemplary embodiment.

FIG. 9 is a pictorial diagram for mixing audio content from multiple sources in accordance with another exemplary embodiment. As illustrated, in one context, the user may be listening to music on the earpiece 100 received from a portable media player 155 (e.g., iPod™, Blackberry™, and other devices as known by one of ordinary skill in the relevant arts). During the music, the user may receive a phone call from a remote device 156 via the transceiver 204 (See FIG. 2). The processor 206 responsive to identifying the user context, can audibly mix the received phone call of the mobile device communication with the audio content. For instance, the processor 206 can ramp down the volume of the music 141 and at approximately the same time ramp up the volume of the incoming phone call 142. This provides a pleasant audible transition between the music and the phone call. The user context can include receiving a phone call while audio content is playing, receiving a voice mail or voice message while audio content is playing, receiving a text-to-speech message while audio content is playing, or receiving a voice mail during a phone call. Notably, various mixing configuration are herein contemplated and are not limited to those shown. It should also be noted that the ramping up and down can be performed in conjunction with the PHL 430 in order to adjust the volumes in accordance with the user's hearing sensitivity.

As shown in step 708, the processor can spectrally enhance the audio content in view of the ambient sound. Moreover, a timbral balance of the audio content can be maintained by taking into account level dependant equal loudness curves and other psychoacoustic criteria (e.g., masking) associated with the personalized hearing level (PHL). For instance, auditory queues in a received audio content can be enhanced based on the PHL and a spectrum of the ambient sound captured at the ASM 110. Frequency peaks within the audio content can be elevated relative to ambient noise frequency levels and in accordance with the PHL to permit sufficient audibility of the ambient sound. The PHL reveals frequency dynamic ranges that can be used to limit the compression range of the peak elevation in view of the ambient noise spectrum.

In one arrangement, the processor 206 can compensate for a masking of the ambient sound by the audio content. Notably, the audio content if sufficiently loud, can mask auditory queues in the ambient sound, which can i) potentially cause hearing damage, and ii) prevent the user from hearing warning sounds in the environment (e.g., an approaching ambulance, an alarm, etc.) Accordingly, the processor 206 can accentuate and attenuate frequencies of the audio content and ambient sound to permit maximal sound reproduction while simultaneously permitting audibility of ambient sounds. In one arrangement, the processor 206 can narrow noise frequency bands within the ambient sound to permit sensitivity to audio content between the frequency bands. The processor 206 can also determine if the ambient sound contains salient information (e.g., warning sounds) that should be un-masked with respect to the audio content. If the ambient sound is not relevant, the processor 206 can mask the ambient sound (e.g., increase levels) with the audio content until warning sounds are detected.

In another arrangement, in accordance with step 708, the processor 206 can filter the sound of the user's voice captured at the ASM 110 when the user is speaking such that the user hears himself or herself with a similar timbral quality as if the earpiece 100 were not inserted. For instance, a voice activity detector within the earpiece 100 can identify when the user is speaking and filter the speech captured at the ASM 110 with an equalization that compensates for the insertion of the earpiece. As one example, the processor 206 can compare the spectrum captured at the ASM 110 with the spectrum at the ECM 130, and equalize for the difference.

The earpiece 100 can process the sound reproduced by the ECR 120 in a number of different ways to overcome an occlusion effect, and allow the user to select an equalization filter that yields a preferred sound quality. In conjunction with the user selected subjective customization, the processor 206 can further predict an approximation of an equalizing filter by comparing the ASM 110 signal and ECM 130 signal in response to user-generated speech.

The processor 206 can also compensate for an ear seal leakage due to a fitting of the device with the ear canal. As previously noted, the ear seal profile identifies transmission levels of frequencies through the ear canal 140. The processor 206 can take into account the ear seal leakage when performing peak enhancement, or other spectral enhancement techniques, to maintain minimal audibility of the ambient noise while audio content is playing. Although not shown, the processor by way of the ECM 130 and ECR 120 can additionally measure otoacoustic emissions to determine a hearing sensitivity of the user when taking into account peak enhancement.

In another configuration, the processor 206 can implement a "look ahead" analysis system for reproduction of pre-recorded audio content, using a data buffer to offset the reproduction of the audio signal. The look-ahead system allows the processor to analyze potentially harmful audio artifacts (e.g. high level onsets, bursts, etc.) either received from an external media device, or detected with the ambient microphones, in-situ before it is reproduced. The processor 206 can thus mitigate the audio artifacts in advance to reduce timbral distortion effects caused by, for instance, attenuating high level transients.

The earpiece 100 can actively monitor and adjust the ambient sound to preserve a constant loudness relationship between the audio content and the environment. For instance, if at step 710, the ambient sound increases, the processor 206 can raise the level of the audio content in accordance with the PHL 420 to maintain a constant audio content level to ambient sound level as shown in step 712. This also maintains intelligibility in fluctuating ambient noise environments. The processor 206 can further limit the increase to comply with the maximum comfort level of the user. In practice, the processor 206 can perform multiband analysis to actively monitor the ambient sound level and adjust the audio via multiband compression to ensure that the audio content-to-ambient sound ratio within the (occluded) ear canal(s) is maintained at a level conducive for good intelligibility of the audio content, yet also at a personalized safe listening level and permitting audible environmental awareness. The processor 206 can maintain the same audio content to ambient sound ratio if the ambient sound does not increase unless otherwise directed by the user.

At step 714, the processor 206 can monitor sound signatures in the environment from the ambient sound received from ASM 110. A sound signature can be defined as a sound in the user's ambient environment which has significant perceptual saliency. Sound signatures for various environmental sounds or warning sounds can be provided in a database available locally or remotely to the earpiece 100. As an example, a sound signature can correspond to an alarm, an ambulance, a siren, a horn, a police car, a bus, a bell, a gunshot, a window breaking, or any other sound. The sound signature can include features characteristic to the sound. As an example, the sound signature can be classified by statistical features of the sound (e.g., envelope, harmonics, spectral peaks, modulation, etc.).

The earpiece 100 can continually monitor the environment for warning sounds, or monitor the environment on a scheduled basis. In one arrangement, the earpiece 100 can increase monitoring in the presence of high ambient noise possibly signifying environmental danger or activity. The processor 206 can analyze each frame of captured ambient noise for features, compare the features with reference sounds in the database, and identify probable sound signature matches. If at step 716, a sound signature of a warning sound is detected in the ambient sound, the processor at step 718 can selectively attenuate at least a portion of the audio content, or amplify the warning sound. For example, spectral bands of the audio content that mask the warning sound can be suppressed to increase an audibility of the warning sound.

Alternatively, the processor 206 can present an amplified audible notification to the user via the ECR 120 as shown in step 720. The audible notification can be a synthetic voice identifying the warning sound (e.g. "car alarm"), a location or direction of the sound source generating the warning sound (e.g. "to your left"), a duration of the warning sound (e.g., "3 minutes") from initial capture, and any other information (e.g., proximity, severity level, etc.) related to the warning sound. Moreover, the processor 206 can selectively mix the warning sound with the audio content based on a predetermined threshold level. For example, the user may prioritize warning sound types for receiving various levels of notification, and/or identify the sound types as desirable of undesirable. The processor 206 can also send a message to a device operated by the user to visually display the notification as shown in step 722. For example, the user's cell phone paired with the earpiece 100 can send a text message to the user, if, for example, the user has temporarily turned the volume down or disabled audible warnings. In another arrangement, the earpiece 100 can send a warning message to nearby people (e.g., list of contacts) that are within a vicinity of the user, thereby allowing them to receive the warning.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

What is claimed is:

1. An electronic audio device for use with at least one earpiece or a pair of earpieces, or a pair of earpieces in a headphone, each earpiece having a microphone operatively coupled to the earpiece and a speaker located therein, comprising:

circuitry operatively coupled to the microphone and speaker;

a processor operatively coupled to evaluate a seal quality of the earpiece to a user's ear based on seal quality measurements made while driving or exciting a signal into the speaker located in the earpiece and then to adjust the circuitry coupled to the microphone and speaker according to the evaluated seal quality; and wherein the processor is configured to generate a visual or audio message identifying whether the at least one earpiece is properly inserted based on the seal quality measurements.

2. The electronic audio device according to claim 1 further comprising a wired or wireless connection that couples to an electronic device to receive audio signals that are used to drive the signal into the speaker located in the at least one earpiece or the pair of earpieces in a headphone.

3. The electronic audio device of claim 1, wherein the processor by way of the speaker and microphone adjusts the audio in accordance with a personalized hearing level (PHL) to compensate for an ear seal leakage.

4. The electronic audio device of claim 1, wherein the processor measures differences in a further sound pressure level between an ambient microphone and the microphone, and determines a sealing profile of the earpiece with the ear canal based on the differences.

5. The earpiece of claim 1, wherein the processor determines whether the earpiece is properly inserted based on a sealing profile; and generates the visual or audio message identifying compliance or lack of compliance with the sealing profile.

6. The earpiece of claim 1, wherein the processor by way of the speaker and microphone in the earpiece performs in-situ measurement of a user's ear anatomy to produce an ear canal transfer function (ECTF) when the earpiece is in use.

7. The earpiece of claim 6, wherein the processor monitors changes in the ECTF to determine a sealing level of the earpiece with the ear canal.

8. The earpiece of claim 1, further comprising a transceiver operatively coupled to the processor to receive and transmit signals.

9. The earpiece of claim 1, wherein the processor audibly mixes a received mobile device communication with the audio content depending on a user context that is at least one among receiving a phone call while the audio content is playing, receiving a voice mail or voice message while the audio content is playing, receiving a text-to-speech message while the audio content is playing, and receiving the voice mail during a phone call.

10. The earpiece of claim 1, wherein the microphone in the earpiece is an ear canal microphone.

11. A hearing measurement and listening device, comprising:

an ambient sound microphone (ASM) configured to capture ambient sound;

a processor configured to produce audio from at least in part the ambient sound and an audio content;

at least one ear canal receiver (ECR) configured to deliver the audio to the ear canal, wherein the ECR is operatively coupled to the processor;

an ear canal microphone (ECM) to measure a sound pressure level (SPL) of the audio within the ear canal, wherein the processor by way of the at least one ECR and ECM adjusts the audio to compensate for an ear seal leakage; and wherein the processor monitors changes in the ear canal transfer function (ECTF) to determine a sealing level of the earpiece with the ear canal.

12. The device of claim 11, wherein the processor measures differences in a second Sound Pressure Level (SPL) between the ASM and the ECM, and determines a sealing profile of the device with the ear canal based on the differences.

13. The device of claim 12, wherein the processor determines whether the earpiece is properly inserted based on the sealing profile;

adjusts the audio in accordance with a personalized hearing level (PHL) to compensate for the ear seal leakage; and generates an audible or visual message identifying the sealing profile.

14. The device of claim 11, wherein the processor by way of the ECR and ECM performs in-situ measurement of a user's ear anatomy to produce an ear canal transfer function (ECTF) when the device is in use.

15. The device of claim 11, further comprising a transceiver operatively coupled to the processor to receive and transmit signals.

16. The device of claim 11, wherein the processor audibly mixes a received mobile device communication with audio content depending on a user context that is at least one among receiving a phone call while the audio content is playing, receiving a voice mail or voice message while the audio content is playing, receiving a text-to-speech message while the audio content is playing, and receiving a voice mail during a phone call.

17. A non-transitory memory containing instructions for personalized hearing measurement and listening for an earpiece, the execution of the instructions by one or more processors of a computer system causing the one or more processors to perform operations comprising:

delivering audio to an ear canal using an ear canal receiver coupled to the one or more processors;

measuring a sound pressure level (SPL) of the audio within the ear canal using an ear canal microphone;

wherein the one or more processors by way of the ear canal microphone and ear canal receiver adjusts the audio to compensate for an ear seal leakage; and wherein the processor is configured to determine whether the earpiece is or was properly inserted and to generate an audible or visual message identifying whether the earpiece is properly inserted.

18. The non-transitory memory of claim 17, further comprising instructions causing the processor to measure differences in a second sound pressure level (SPL) between an ambient sound microphone and the ear canal microphone, and determines a sealing profile of the earpiece with the ear canal based on the differences.

19. The non-transitory memory of claim 17, further comprising instructions causing the processor to determine whether the earpiece is or was properly inserted based on a sealing profile and to generate the audible or visual message identifying the sealing profile.

* * * * *